US006536470B1

(12) United States Patent
Carn et al.

(10) Patent No.: US 6,536,470 B1
(45) Date of Patent: Mar. 25, 2003

(54) BACK FLOW PREVENTION VALVE

(76) Inventors: Wayne J. Carn, 103 Norrie Avenue, Whyalla 5608 (AU); Eric Murray, 103 Norrie Avenue, Whyalla 5608 (AU); Russell J. Sawford, 103 Norrie Avenue, Whyalla 5608 (AU)

( * ) Notice: Subject to any disclaimer, the term of this patent is extended or adjusted under 35 U.S.C. 154(b) by 158 days.

(21) Appl. No.: 09/844,328

(22) Filed: Apr. 27, 2001

(51) Int. Cl.[7] ..... F16K 37/00

(52) U.S. Cl. ..... 137/554; 137/557; 137/505.25; 137/545; 138/45; 4/314

(58) Field of Search ..... 137/554, 557, 137/505.25, 545; 138/45; 4/300, 314

(56) References Cited

U.S. PATENT DOCUMENTS

| | | | | | |
|---|---|---|---|---|---|
| 1,183,920 | A | * | 5/1916 | Wallace | 137/505.25 |
| 1,504,066 | A | * | 8/1924 | Lutes | 137/505.25 |
| 4,009,592 | A | * | 3/1977 | Boeger | 138/45 |
| 4,230,145 | A | | 10/1980 | Badders | |
| 4,424,952 | A | * | 1/1984 | Thomason et al. | 138/45 |
| D285,716 | S | | 9/1986 | Bova | |
| 4,655,246 | A | * | 4/1987 | Philpot et al. | 137/505.25 |
| 5,052,060 | A | | 10/1991 | Makita et al. | |
| 5,065,786 | A | | 11/1991 | Rozenblatt | |
| 5,652,970 | A | | 8/1997 | Wodeslavsky | |
| 5,944,055 | A | | 8/1999 | Dicky | |
| 6,082,396 | A | * | 7/2000 | Davidson | 137/557 |

* cited by examiner

*Primary Examiner*—A. Michael Chambers

(57) ABSTRACT

A back flow prevention valve for preventing water from draining back into a water supply line. The back flow prevention valve includes a housing comprising a tubular body having a first and second open end each having a respective covering thereon with an aperture extending therethrough. A water supply pipe is fluidly coupled to the aperture in a first covering. A cylinder is coupled to the first covering and extends inward of the tubular body. A piston having a bore extending therethrough is slidably positioned in the cylinder. A biasing member biases the piston toward the first covering. The aperture in the second covering has a ledge therein for opening the valve. A one-way valve is removably coupled to the piston and is adapted for letting water move outwardly through the piston toward the second end of the tubular member.

13 Claims, 9 Drawing Sheets

BACK FLOW PREVENTION VALVE

BACKGROUND OF THE INVENTION

1. Field of the Invention

The present invention relates to valve devices and more particularly pertains to a new back flow prevention valve for preventing water from draining back into a water supply line.

2. Description of the Prior Art

The use of valve devices is known in the prior art. More specifically, valve devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,065,786; U.S. Pat. No. 5,562,970; U.S. Pat. No. 5,944,055; U.S. Pat. No. 5,02,060; U.S. Pat. No. 4,230,145; and U.S. Des. Pat. No. 285,716.

While these devices fulfill their respective, particular objectives and requirements, the aforementioned patents do not disclose a new back flow prevention valve. The inventive device includes a housing comprising a tubular body having a peripheral wall extending between a first end and a second end. Each of the first and second ends define an edge of an opening. A first covering is positioned over the first end of the tubular body has an aperture extending therethrough. A water supply pipe is fluidly coupled to the aperture. An elongated annular lip is coupled to the the first covering and extends inward of the tubular body and defines a cylinder. A cap covers the annular lip and has an opening extending therethrough. A piston is slidably positioned in the cylinder. The piston has a bore extending therethrough along a longitudinal axis of the piston. A biasing member biases the piston toward the aperture in the first covering. A second covering is positioned over the second end of the tubular body. The second covering has an aperture extending therethrough positioned generally co-axial with the aperture in the first covering for allowing water to flow outwardly of the tubular member. The aperture in the second covering has a ledge therein. A one-way valve is removably coupled to a proximal end of the piston with respect to the second covering. The one-way valve is adapted for letting water move outwardly through the piston toward the second end of the tubular member. The one-way valve has a size adapted for extending into the aperture in the second covering. The one-way valve is extendable between an open position retracted inward of the piston and a closed position extending outward of the piston. The one-way valve is abuttable against the ledge such that the one-way valve is moved into the open position, wherein water may flow through the piston and outward through the second covering.

In these respects, the back flow prevention valve according to the present invention substantially departs from the conventional concepts and designs of the prior art, and in so doing provides an apparatus primarily developed for the purpose of preventing water from draining back into a water supply line.

SUMMARY OF THE INVENTION

In view of the foregoing disadvantages inherent in the known types of valve devices now present in the prior art, the present invention provides a new back flow prevention valve construction wherein the same can be utilized for preventing water from draining back into a water supply line.

The general purpose of the present invention, which will be described subsequently in greater detail, is to provide a new back flow prevention valve apparatus and method which has many of the advantages of the valve devices mentioned heretofore and many novel features that result in a new back flow prevention valve which is not anticipated, rendered obvious, suggested, or even implied by any of the prior art valve devices, either alone or in any combination thereof.

To attain this, the present invention generally comprises a housing comprising a tubular body having a peripheral wall extending between a first end and a second end. Each of the first and second ends-define an edge of an opening. A first covering is positioned over the first end of the tubular body has an aperture extending therethrough. A water supply pipe is fluidly coupled to the aperture. An elongated annular lip is coupled to the first covering and extends inward of the tubular body and defines a cylinder. A cap covers the annular lip and has an opening extending therethrough. A piston is slidably positioned in the cylinder. The piston has a bore extending therethrough along a longitudinal axis of the piston. A biasing member biases the piston toward the aperture in the first covering. A second covering is positioned over the second end of the tubular body. The second covering has an aperture extending therethrough positioned generally co-axial with the aperture in the first covering for allowing water to flow outwardly of the tubular member. The aperture in the second covering has a ledge therein. A one-way valve is removably coupled to a proximal end of the piston with respect to the second covering. The one-way valve is adapted for letting water move outwardly through the piston toward the second end of the tubular member. The one-way valve has a size adapted for extending into the aperture in the second covering. The one-way valve is extendable between an open position retracted inward of the piston and a closed position extending outward of the piston. The one-way valve is abuttable against the ledge such that the one-way valve is moved into the open position, wherein water may flow through the piston and outward through the second covering.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new back flow prevention valve apparatus and method which has many of the advantages of the valve devices mentioned heretofore and many novel features that result in a new back flow prevention valve which is not anticipated, rendered obvious, suggested, or even implied by any of the prior art valve devices, either alone or in any combination thereof.

It is another object of the present invention to provide a new back flow prevention valve which may be easily and efficiently manufactured and marketed.

It is a further object of the present invention to provide a new back flow prevention valve which is of a durable and reliable construction.

An even further object of the present invention is to provide a new back flow prevention valve which is susceptible of a low cost of manufacture with regard to both materials and labor, and which accordingly is then susceptible of low prices of sale to the consuming public, thereby making such back flow prevention valve economically available to the buying public.

Still yet another object of the present invention is to provide a new back flow prevention valve which provides in the apparatuses and methods of the prior art some of the advantages thereof, while simultaneously overcoming some of the disadvantages normally associated therewith.

Still another object of the present invention is to provide a new back flow prevention valve for preventing water from draining back into a water supply line.

Yet another object of the present invention is to provide a new back flow prevention valve which includes a housing comprising a tubular body having a peripheral wall extending between a first end and a second end. Each of the first and second ends define an edge of an opening. A first covering is positioned over the first end of the tubular body has an aperture extending therethrough. A water supply pipe is fluidly coupled to the aperture. An elongated annular lip is coupled to the first covering and extends inward of the tubular body and defines a cylinder. A cap covers the annular lip and has an opening extending therethrough. A piston is slidably positioned in the cylinder. The piston has a bore extending therethrough along a longitudinal axis of the piston. A biasing member biases the piston toward the aperture in the first covering. A second covering is positioned over the second end of the tubular body. The second covering has an aperture extending therethrough positioned generally co-axial with the aperture in the first covering for allowing water to flow outwardly of the tubular member. The aperture in the second covering has a ledge therein. A one-way valve is removably coupled to a proximal end of the piston with respect to the second covering. The one-way valve is adapted for letting water move outwardly through the piston toward the second end of the tubular member. The one-way valve has a size adapted for extending into the aperture in the second covering. The one-way valve is extendable between an open position retracted inward of the piston and a closed position extending outward of the piston. The one-way valve is abuttable against the ledge such that the one-way valve is moved into the open position, wherein water may flow through the piston and outward through the second covering.

Still yet another object of the present invention is to provide a new back flow prevention valve that is retrofittable to existing plumbing devices and is easily disassembled for refitting of components.

Even still another object of the present invention is to provide a new back flow prevention valve that has an alarm system thereon for signaling when the device is malfunctioning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
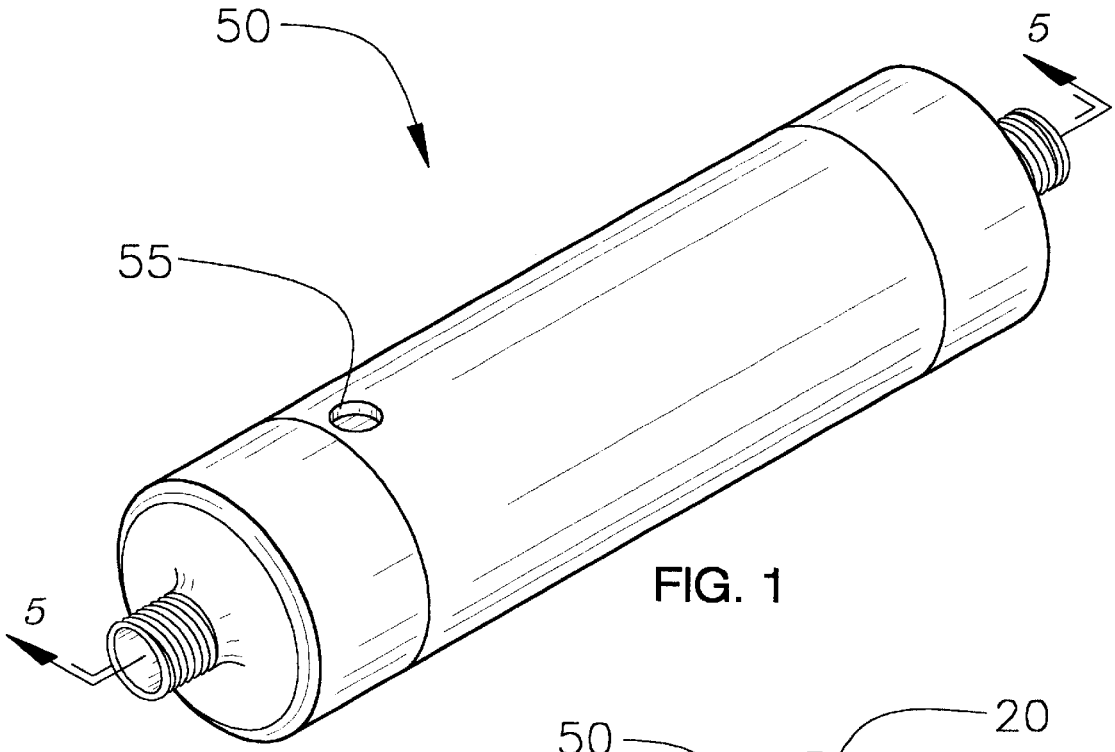
FIG. 1 is a schematic perspective view of a new back flow prevention valve according to the present invention.
Figure 2:
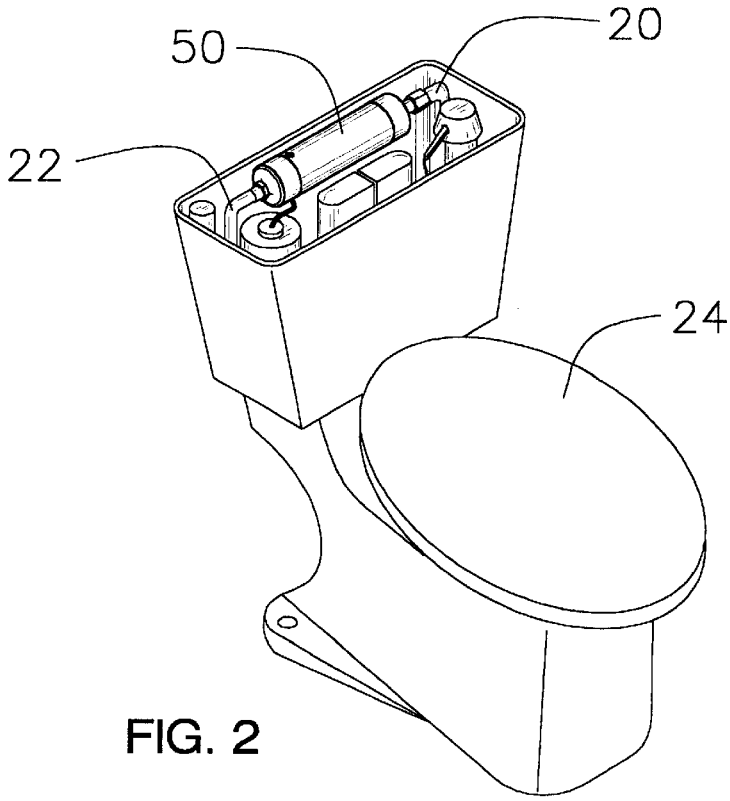
FIG. 2 is a schematic in-use view of the present invention.
Figure 3:
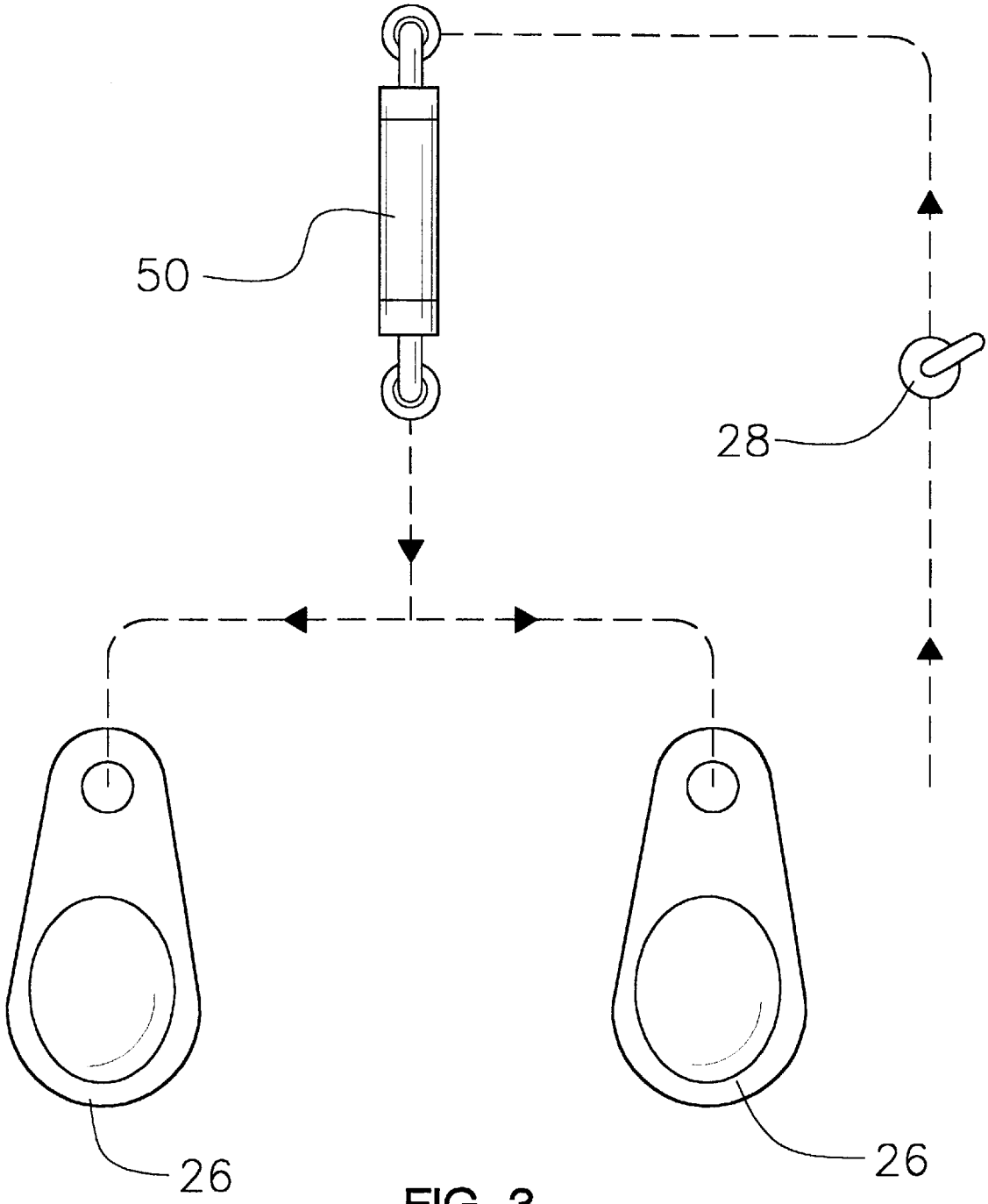
FIG. 3 is a schematic front in-use view of the present invention.
Figure 4:
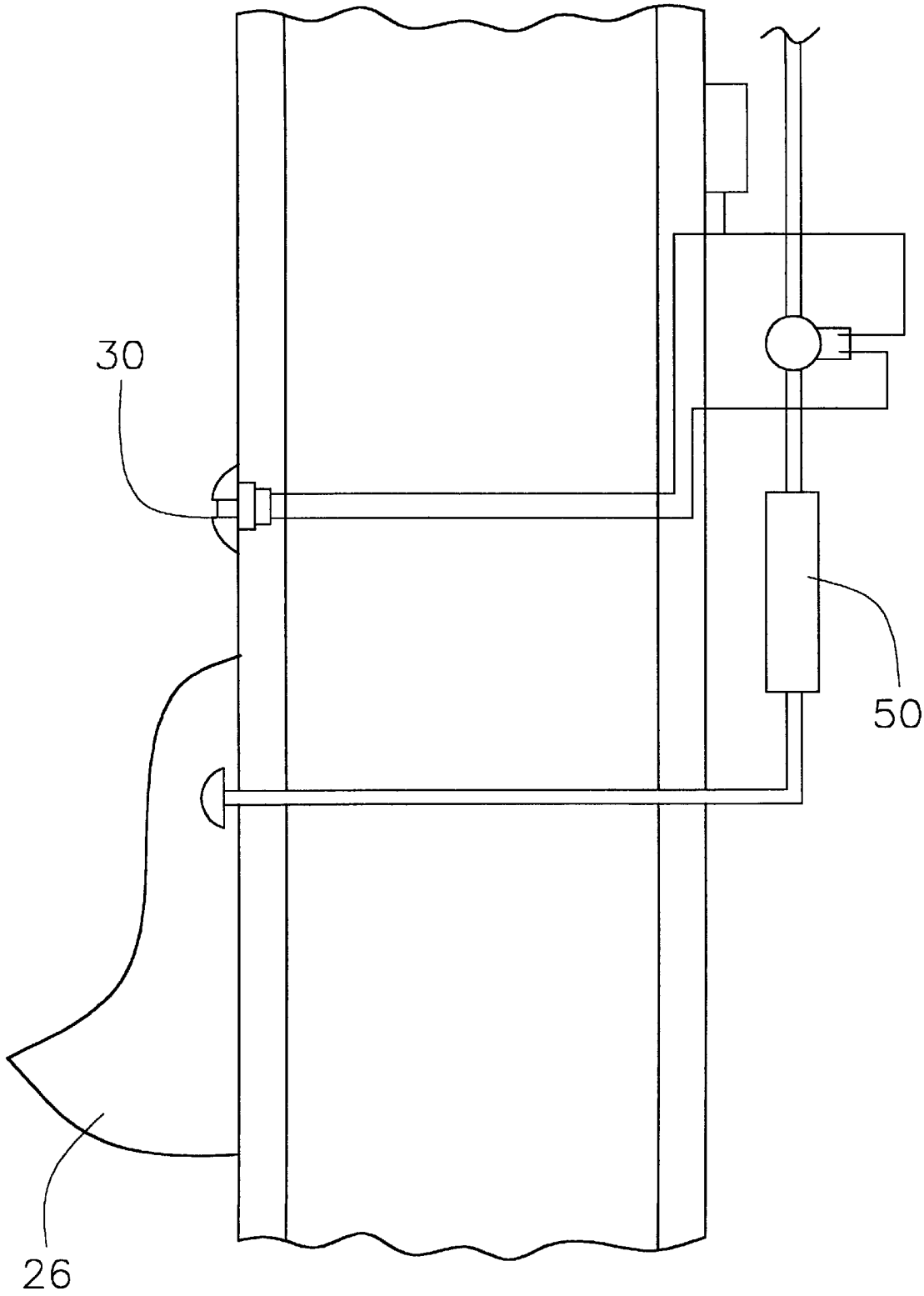
FIG. 4 is a schematic side in-use view of the present invention.
Figure 5:
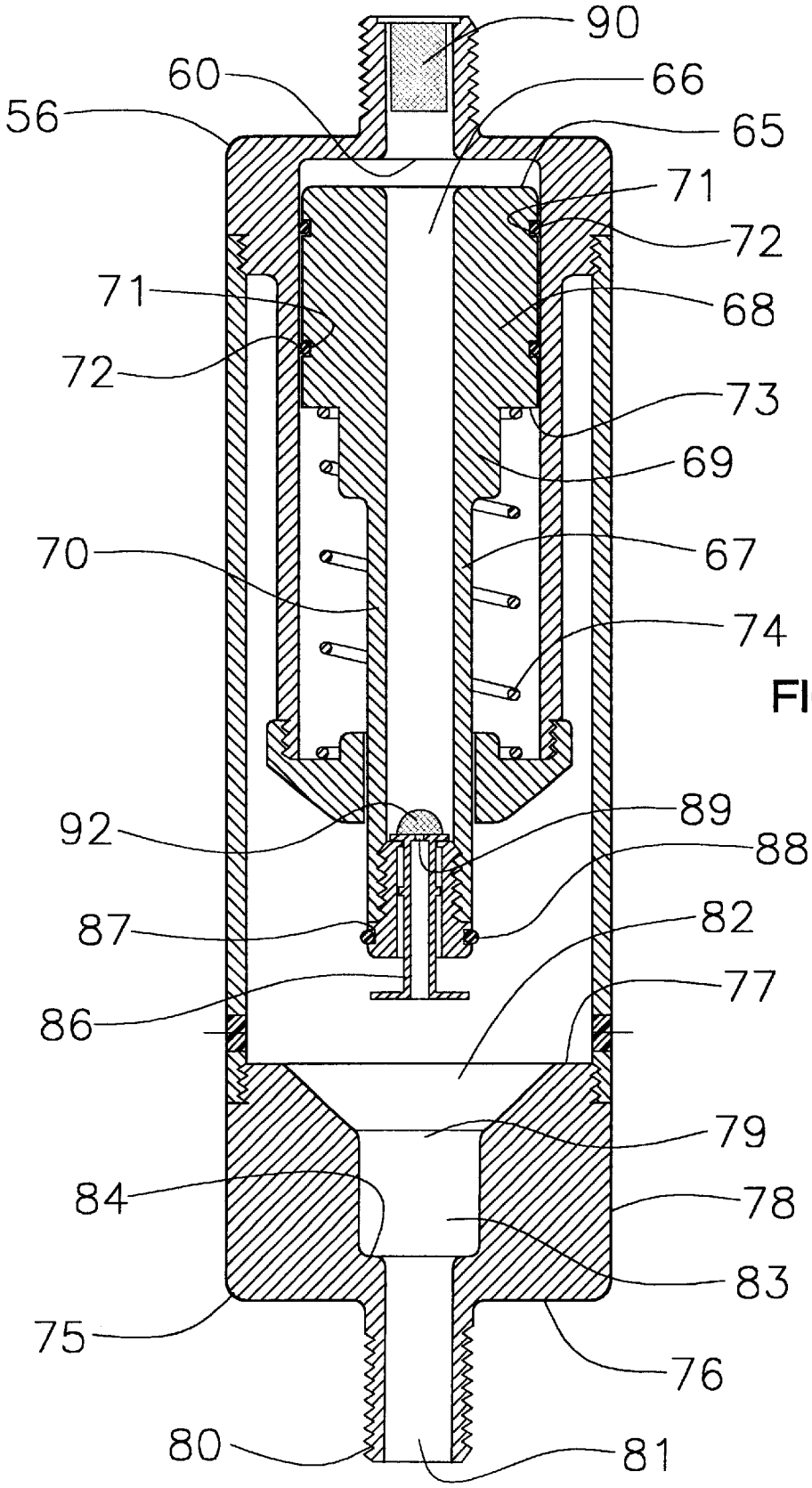
FIG. 5 is a schematic cross-sectional view of the present invention.
Figure 6:
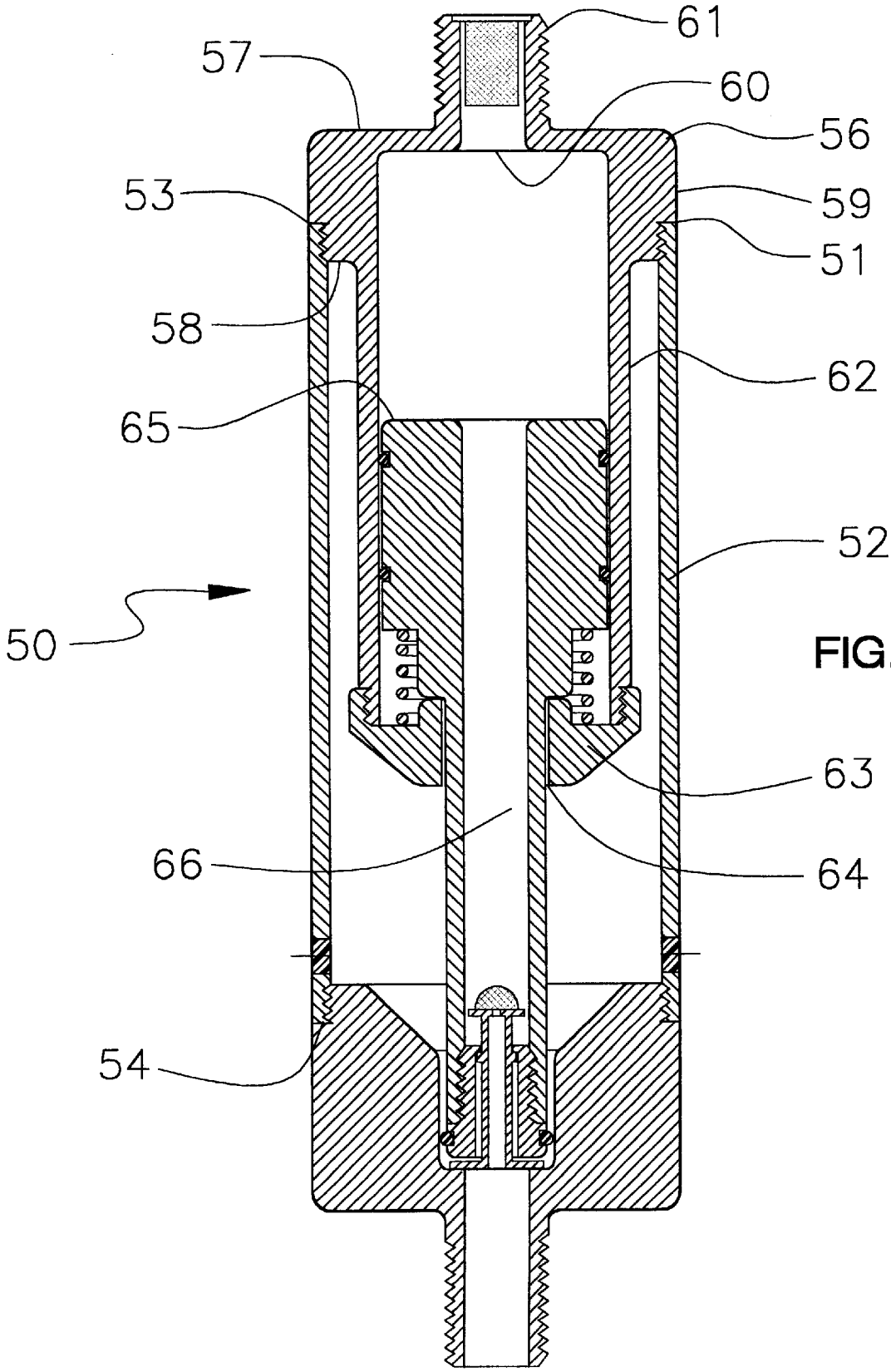
FIG. 6 is a schematic cross-sectional view of the present invention.

With reference now to the drawings, and in particular to FIGS. 1 through 11 thereof, a new back flow prevention valve embodying the principles and concepts of the present invention and generally designated by the reference numeral 50 will be described.

As best illustrated in FIGS. 1 through 11, the back flow prevention valve 10 generally comprises an apparatus for preventing water from moving from a destination spot 20, such as toilets 24 and urinals 26, back into a water supply when the water supply has negative pressure. The apparatus is in fluid connection with a water supply pipe 22 and is removable from the water supply pipe. The back-flow prevention valve 50 includes a housing 51 comprising a tubular body having a peripheral wall 52 extending between a first end 53 and a second end 54. Each of the first 53 and second 54 ends defines an edge of an opening. The peripheral wall 52 preferably has at least one opening 55 therein for releasing water for reasons explained below.

A first covering 56 is positioned over the first end 53 of the tubular body, or housing 51 of the back-flow prevention valve 50. The first covering 56 has a first side 57, a second side 58 and a peripheral edge 59 extending between the first 57 and second 58 sides. The peripheral edge 59 is adapted for threadably engaging the peripheral wall 52 such that the first covering 56 covers the opening in the first end 53. The first covering 56 has an aperture 60 extending therethrough. An annular flange 61 is attached to an edge of the aperture 60 and extends away from the tubular body 51. The annular flange 61 is threaded for releasably engaging the water supply pipe 15 such that water may flow into the tubular body 51 through the first covering 56. An elongated annular lip 62 is coupled to the second side 58 of the first covering 56 and extends inward of the tubular body 51. The annular lip 62 defines a cylinder.

A cap 63 is threadably engaged to the annular lip 62. The cap 63 has an opening 64 extending therethrough, which is generally axially aligned with the aperture 60 in the first covering 56.

A piston 65 is slidably positioned in the cylinder 62. The piston 65 has a bore 66 extending therethrough along a longitudinal axis of the piston 65. The piston 65 has an outer surface 67. The piston 65 is elongated and has a distal portion 68, a middle portion 69 and a proximal portion 70 with respect to the second end 54 of the tubular body 51. The bore 66 extends through all three portions of the piston 65. The distal portion 68 has a diameter substantially equal to the annular lip 62. The outer surface 67 of the distal portion 68 has a pair of spaced depressions 71 therein extending around the piston 65. Each of a pair of seals 72 is positioned in one of the depressions 71. The middle portion 69 has a diameter smaller than the diameter of the distal portion 68 and greater than a diameter of the opening 64 in the cap 63 such that a shoulder 73 is defined between the distal 68 and middle 69 portions.

A biasing member 74 biases the piston 65 toward the aperture 60 in the first covering 56. The biasing member extends between and abuts against the shoulder and the cap. The biasing member comprises a compression spring wound about the piston 65.

A second covering 75 is positioned over the second end 54 of the tubular body 51. The second covering 75 has a first side 76, a second side 77 and a peripheral edge 78 extending between the first 76 and second 77 sides. The peripheral edge 78 of the second covering 75 is adapted for threadably engaging the peripheral wall 52 such that the second covering 75 covers the opening in the second end 54. The second covering 75 has an aperture 79 extending therethrough and is positioned generally co-axial with the aperture 60 in the first covering 56. An annular flange 80 is attached to an edge of the aperture 79 in the second covering 75 and extending away from the tubular body 51. The annular flange 80 on the second covering 75 is threaded for releasably engaging the water supply pipe 15 such that water may flow outwardly of the tubular body 51 through the second covering 75. The aperture 79 in the second covering 75 is divided into three portions. A first portion 81 abuts the first side 76, a second portion 82 abuts the second side 77 and a middle portion 83 is located between the first 81 and second 82 portions. The second portion 82 has a funnel shape and narrows toward the middle portion 83. The middle portion 83 and the first portion 81 each have a cylindrical shape. The middle portion 83 has a greater diameter than the first portion 81 such that a ledge 84 is defined between the first 81 and third 83 portions.

A one-way valve 86 is removably coupled to the proximal portion 67 of the piston 65. The one-way valve 86 is adapted for letting water move outwardly through proximal portion 67 of the piston 65. The one-way valve 86 has a size adapted for extending into the second 82 and middle 83 portions of the aperture 79 in the second covering 75. The one-way valve 86 is extendable between an open position retracted inward of the piston as in FIG. 6 and a closed position extending outward of the piston as in FIG. 5. The valve 86 is abuttable against the ledge 84 which moves the one-way valve 86 into the open position such that water may flow through the piston 65 and outward through the second covering 75. The one-way valve 86 has an outer surface having a groove 87 therein. A seal 88 is positioned in the groove 87 for generally forming a seal between the one-way valve 86 and the middle portion 83 of the aperture 79 when the valve 86 is located in the aperture 79. A pin-hole 89 extends through the one-way valve 86 for releasing water pressure.

A first filter 90 is removably attached to the first covering 56 and is located in the aperture 60 in the first covering 56. A second filter 92 is attached to the one-way valve 86. The second filter 92 is located within the piston 67 and covers the pin hole 89. The filters prevent the back-flow prevention valve 50 from becoming clogged with waterborne particles.

Figure 10:
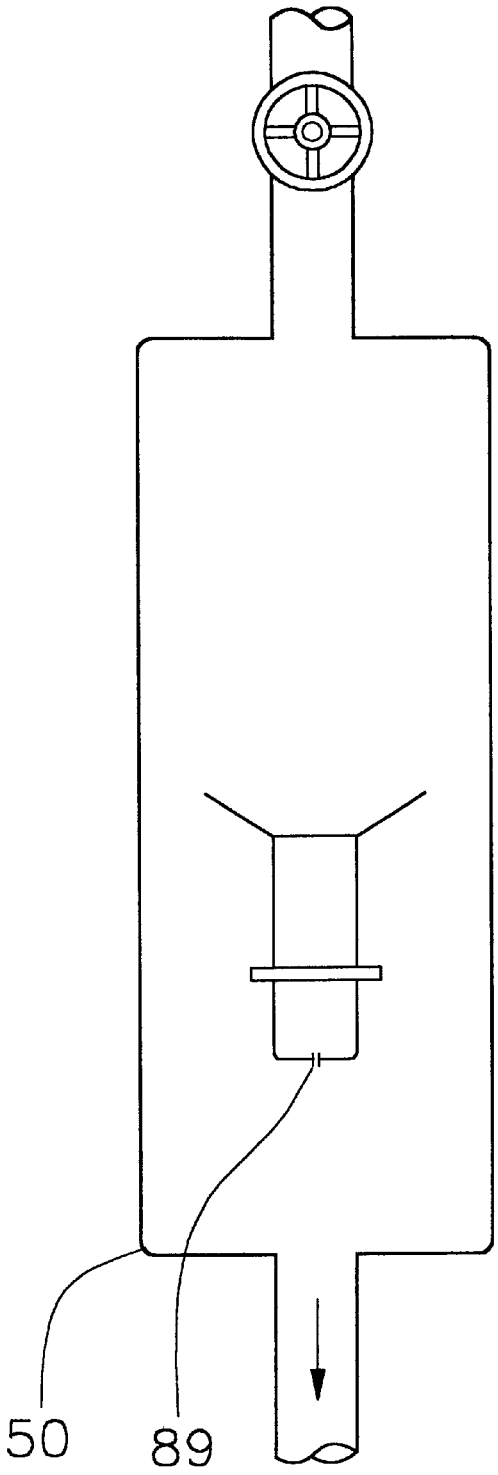
FIG. 10 is a schematic front view of the present invention.
Figure 11:
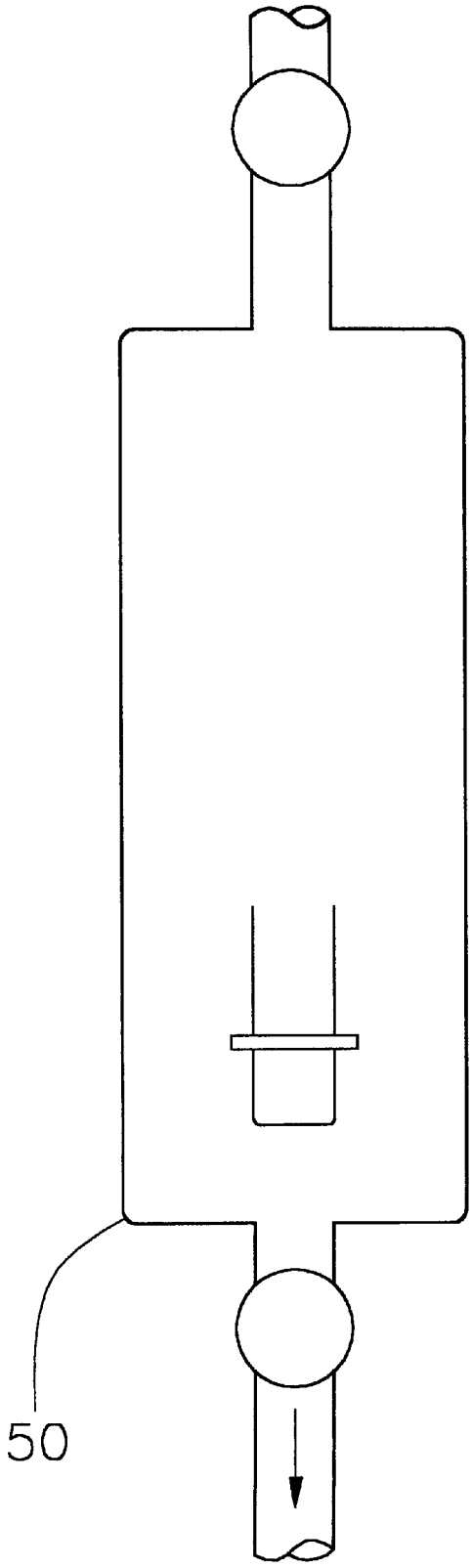
FIG. 11 is a schematic front view of the present invention.

FIGS. 10 and 11 depict an improvement in the device for use with constant water pressure where an actuator 28, or motion sensor 30, for flushing is not used. FIG. 10 depicts the embodiment as described above with a pin-hole 89 therein. FIG. 11 contains no pin-hole 89 as the pin-hole is not required where water pressure is constant.

An alarm system signals a malfunction, or lack of retraction, of the piston 65. The alarm system includes coupler 100 for positioning between and fluidly coupling the water supply pipe 22 and the flange 61 on the first covering 56.

A diaphragm 102 is attached to an inner wall of the coupler 100. The diaphragm 102 is resiliently elastic.

A pin 104 extends through an outer wall of the coupler 102 and has a first end 106 abutting the diaphragm 102. The diaphragm 102 forms a seal around the pin 104.

An urging member 108 urges the pin 104 against the diaphragm 102 such that the diaphragm 102 is urged toward a central area of the coupler 100. The urging member 108 is preferably a compression spring wound about the pin 104 and abuts a plate defining the first end 106 of the pin 104.

Figure 7:
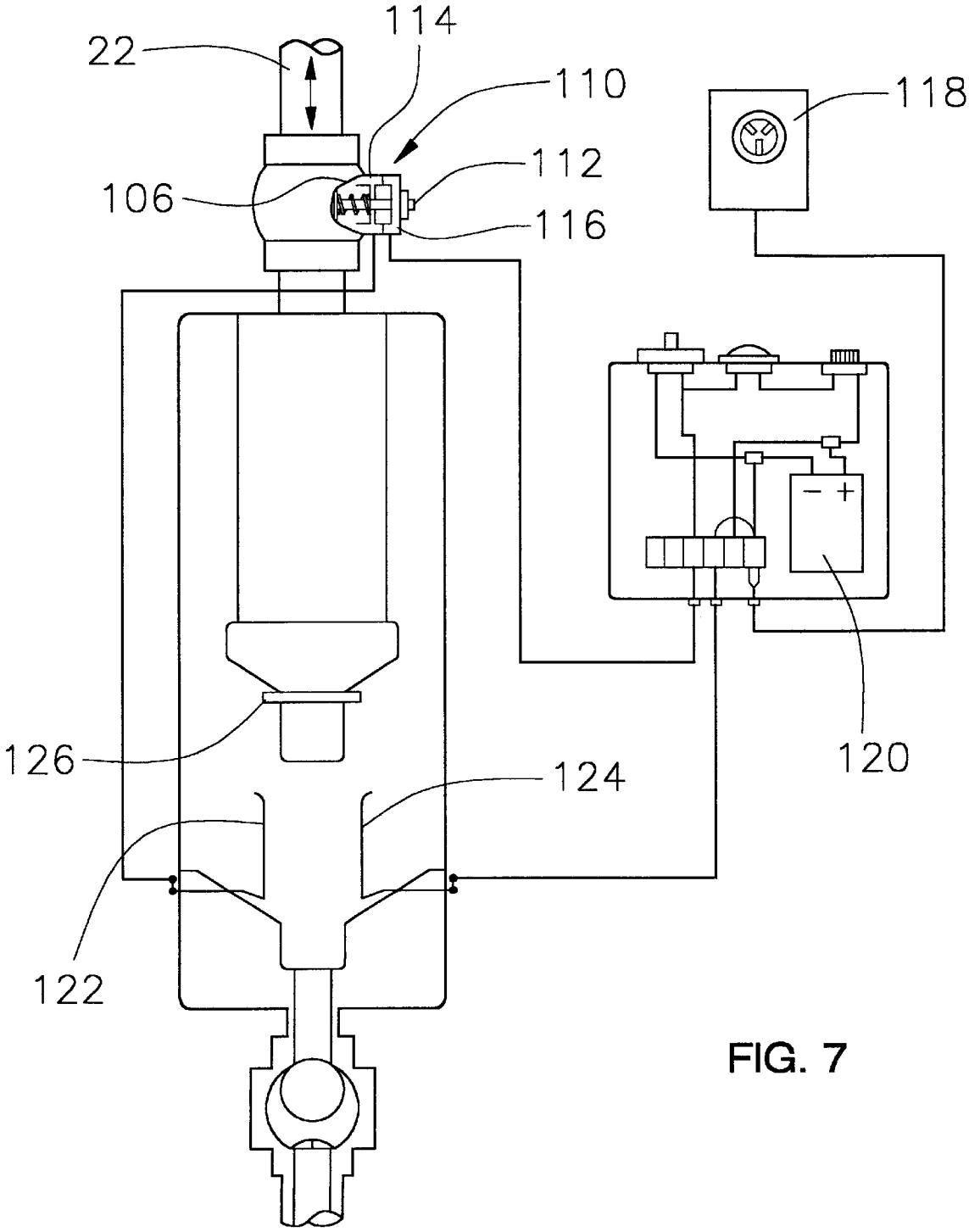
FIG. 7 is an electronic schematic view of the alarm system of the present invention.
Figure 8:
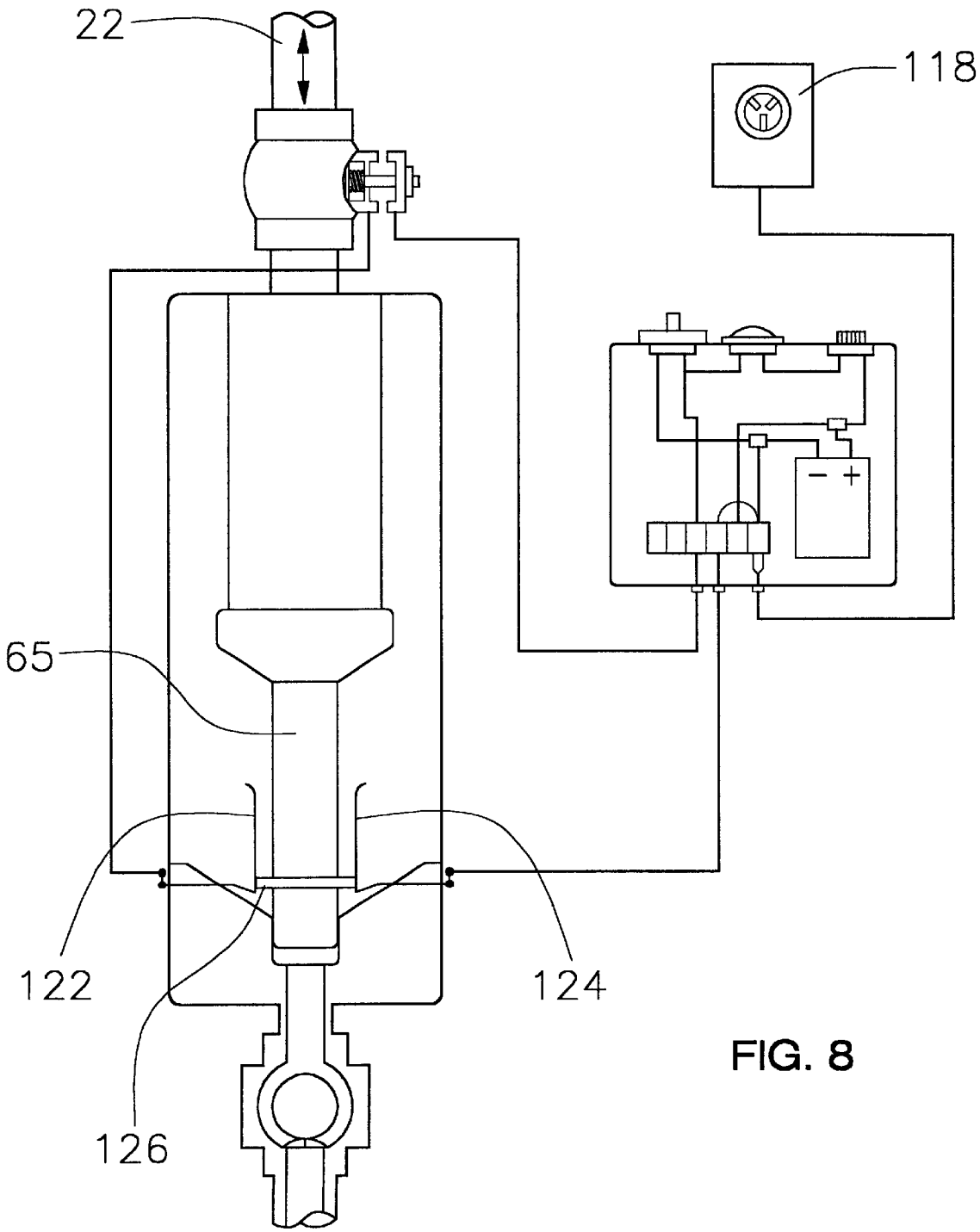
FIG. 8 is an electronic schematic view of the alarm system of the present invention.
Figure 9:
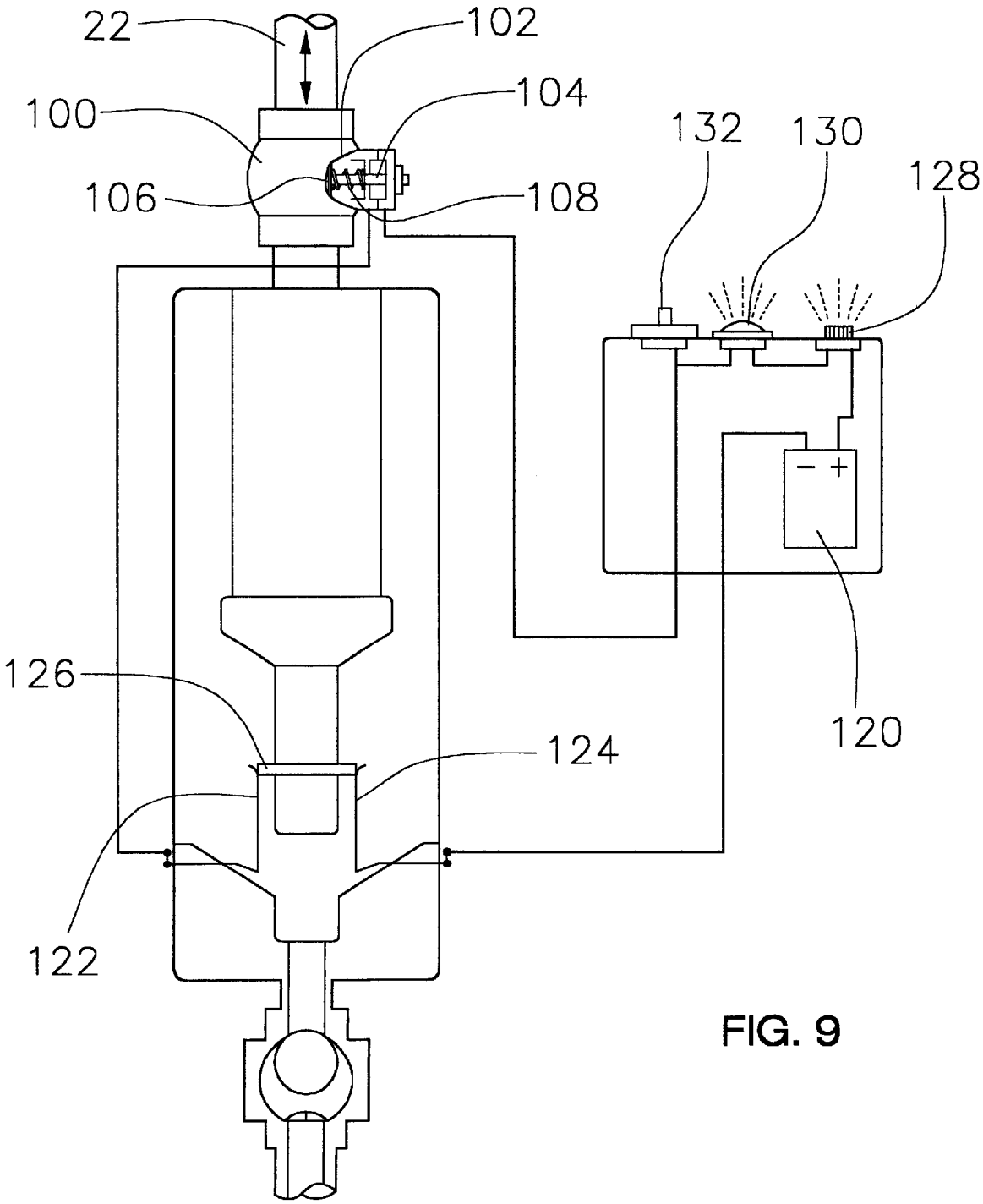
FIG. 9 is an electronic schematic view of the alarm system of the present invention.

A switch 110 is attached to the coupler 100. A second end 112 of the pin 104 extends through the coupler 100 and engages the switch 110. The switch 110 includes a first contact 114 attached to the coupler 100 and a second contact 116 attached to the second end 112 of the pin 104. The first 114 and second 116 contacts abut each other when the pin 104 is urged inward of the coupler 100 as depicted in FIGS. 7 and 9.

A power supply 118 is operationally coupled to the second contact 116. The power supply 118 is preferably hard wired into the wiring of the dwelling and may include a back-up battery 120.

A first interior contact 122 is positioned in the aperture 81 in the second covering 75 and extends inward of the tubular body 51. The first contact 114 on the coupler is operationally coupled to the first interior contact 122.

A second interior contact 124 is positioned in the aperture 81 in the second covering 75 and extends inward of the tubular body 51. The second interior contact 124 is positioned generally opposite of the first interior contact 122. The second interior contact 124 is operationally coupled to the power supply 118.

A third interior contact 126 is attached to and extends around the piston 65. The third interior contact 126 is located on the proximal portion 70 of the piston 65. The third interior contact 126 comes in contact with the first 122 and second 124 interior contacts when the piston 65 extends toward the second end 54 of the tubular member 51 to close a circuit between the first contact 114 of the switch 110 and the power supply 118.

A speaker 128 for emitting a sound is electrically coupled to the switch 110. A light 130 is also preferably electrically coupled to the switch 110. A test button 132 is operationally coupled to the power supply 118, the light 130 and the speaker 128, wherein depressing the test button 132 illuminates the light 130 and sounds the speaker 128 to test the power supply.

In use, the back-flow prevention valve 50 prevents any water from the elongated pipe 15 from moving back into the water supply pipe 14. When the piston 65 retracts and closes the valve, any water trapped in the tubular body 51 may be released through the opening 55 in the peripheral wall 52. The speaker 128 will emit a sound and the light 130 will be illuminated if water pressure in the coupler 100 is sufficiently low such that the first contact 114 abuts the second contact 116 and the piston 65 does not retract away from the second covering 75 such that the circuit is closed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A back-flow prevention valve apparatus for preventing water from moving from a destination spot back into a water supply when the water supply has negative pressure, the apparatus being in fluid connection with a water supply pipe and being removably coupled to the water supply pipe, said back-flow prevention valve comprising:

a housing comprising a tubular body having a peripheral wall extending between a first end and a second end, each of said first and second ends defining an edge of an opening;

a first covering positioned over said first end of said tubular body, said first covering having an aperture extending therethrough, said water supply pipe being fluidly coupled to said aperture, an elongated annular lip being coupled to said first covering and extending inward of said tubular body and defining a cylinder;

a cap covering said annular lip and having an opening extending therethrough;

a piston being slidably positioned in said cylinder, said piston having a bore extending therethrough along a longitudinal axis of said piston;

a biasing member for biasing said piston toward said aperture in said first covering;

a second covering for positioning over said second end of said tubular body, said second covering having an aperture extending therethrough and being positioned generally co-axial with said aperture in said first covering for allowing water to flow outwardly of said tubular member, said aperture in said second covering having a ledge therein; and a one-way valve being removably coupled to a proximal end of said piston with respect to said second covering, said one-way valve being adapted for letting water move outwardly through said piston toward said second end of said tubular body, said one-way valve having a size adapted for extending into said aperture in said second covering, said one-way valve being extendable between an open position retracted inward of said piston and a closed position extending outward of said piston, said one-way valve being abuttable against said ledge such that said one-way valve is moved into said open position such that water may flow through said piston and outward through said second covering.

2. The back-flow prevention valve apparatus as in claim 1, wherein said piston has an outer surface, said piston being elongated and having a distal portion, a middle portion and a proximal portion with respect to said second end of said tubular body, wherein said bore extends through all three portions of said piston, said distal portion having a diameter substantially equal to said annular lip, said middle portion having a diameter smaller than said diameter of said distal portion and greater than a diameter of said opening in said cap such that a shoulder is defined between said distal and middle portions.

3. The back-flow apparatus as in claim 2, wherein said outer surface of said distal portion has an a pair of spaced depressions therein extending around said piston, each of a pair of seals being positioned in one of said depressions.

4. The back-flow prevention valve apparatus as in claim 2, wherein said biasing member extends between and abutting against said shoulder and said cap, said biasing member comprising a compression spring wound about said piston.

5. The back-flow prevention valve apparatus as in claim 1, wherein said second covering has a first side facing outward of said tubular body and a second side facing inward of said tubular body, said aperture in said second covering having a first portion abutting said first side, a second portion abutting said second side and a middle portion located between said first and second portions, said second portion having a funnel shape and narrowing toward said middle portion, said middle portion and said first portions having a cylindrical shape, said middle portion having a greater diameter than said first portion such that said ledge is defined between said first and third portions.

6. The back-flow prevention valve apparatus as in claim 1, wherein said one-way valve has an outer surface having a groove therein, a seal being positioned in said groove for generally forming a seal between said one-way valve and said middle portion of said aperture when said one-way valve is located in said aperture in said second covering.

7. The back-flow prevention valve apparatus as in claim 1, wherein a pin-hole extends through said one-way valve for releasing water pressure.

8. The back-flow prevention valve apparatus as in claim 7, further including:

a first filter being attached to said first covering and being located in said aperture in said first covering;

a second filter being attached to said one-way valve, said second filter being located within said piston and covering said pin hole.

9. The back-flow prevention valve apparatus as in claim 1, further including an alarm system for sounding a speaker when said piston fails to retract after water pressure from said water supple pipe entering said tubular housing lowers.

10. The back-flow prevention valve apparatus as in claim 1, further including:

an alarm system for signaling a malfunction of said piston, said alarm system including;

a coupler for positioning between and fluidly coupling said water supply pipe and said flange on said first covering;

a switch being attached to said coupler for detecting relatively high water pressure in said coupler;

a power supply being operationally coupled to said switch;

a first interior contact and second interior contact being positioned in said aperture in said second covering and extending inward of said tubular body, said switch being operation coupled to first and second interior contacts;

a third interior contact being attached to and extending around said piston, said third interior contact being located on said piston, wherein said third interior contact comes in contact with said first and second interior contacts when said piston extends toward said second end of said tubular member to close a circuit between said switch and said power supply;

a speaker for emitting a sound being electrically coupled to said switch;

wherein the speaker will emit a sound if water pressure in said coupler is sufficiently low such that said switch detects an absence of water pressure and said piston does not retract away from said second covering such that the circuit is closed.

11. The back-flow prevention valve apparatus as in claim 10, further including a test button being operationally coupled to said power supply, and said speaker, wherein depressing said test button sounds said speaker to test the power supply.

12. The back-flow prevention valve apparatus as in claim 1, an alarm system for signaling a malfunction of said piston, said alarm system including;

a coupler for positioning between and fluidly coupling said water supply pipe and said flange on said first covering;

a diaphragm being attached to an inner wall of said coupler, said diaphragm being resiliently elastic;

a pin extending through an outer wall of said coupler and having a first end abutting said diaphragm, wherein said diaphragm forms a seal around said pin;

an urging member urges said pin against said diaphragm such that said diaphragm is urged toward a central area of said coupler;

a switch being attached to said coupler, a second end of said pin extending through said coupler and engaging said switch, said switch including a first contact being attached to said coupler and a second contact being attached to said second end of said pin, wherein said first and second contacts abut each other when said pin is urged inward of said coupler;

a power supply being operationally coupled to said second contact;

a first interior contact being positioned in said aperture in said second covering and extending inward of said tubular body, said first contact on said coupler being operationally coupled to said first interior contact;

a second interior contact being positioned in said aperture in said second covering and extending inward of said tubular body, said second interior contact being positioned generally opposite of said first interior contact, said second interior contact being operationally coupled to said power supply;

a third interior contact being attached to and extending around said piston, said third interior contact being located on said proximal portion of said piston, wherein said third interior contact comes in contact with said first and second interior contacts when said piston extends toward said second end of said tubular member to close a circuit between said first contact of said switch and said power supply;

a speaker for emitting a sound being electrically coupled to said switch;

a light being electrically coupled to said switch;

a test button being operationally coupled to said power supply, said light and said speaker, wherein depressing said test button illuminates said light and sounds said speaker to test the power supply; and wherein the speaker will emit a sound and the light will be illuminated if water pressure in said coupler is sufficiently low such that said first contact abuts said second contact and said piston does not retract away from said second covering such that the circuit is closed.

13. A back-flow prevention valve apparatus for preventing water from moving from a destination spot back into a water supply when the water supply has negative pressure, the apparatus being in fluid connection with a water supply pipe and being removable from the water supply pipe, said back-flow prevention valve comprising:

a housing comprising a tubular body having a peripheral wall extending between a first end and a second end, each of said first and second ends defining an edge of an opening, said peripheral wall having at least one opening therein;

a first covering for positioning over said first end of said tubular body, said first covering having a first side, a second side and a peripheral edge extending between said first and second sides, said peripheral edge being adapted for threadably engaging said peripheral wall such that said first covering covers said opening in said first end, said first covering having an aperture extending therethrough, an annular flange being attached to an edge of said aperture and extending away from said tubular body, said annular flange being threaded for releasably engaging said water supply pipe such that water may flow into said tubular body through said first covering, an elongated annular lip being coupled to said second side of said first covering and extending inward of said tubular body, said annular lip defining a cylinder;

a cap being threadably engaged to said annular lip, said cap having an opening extending therethrough and being generally axially aligned with said aperture with said first covering;

a piston being slidably positioned in said cylinder, said piston having a bore extending therethrough along a longitudinal axis of said piston, said piston having an outer surface, said piston being elongated and having a distal portion, a middle portion and a proximal portion with respect to said second end of said tubular body, wherein said bore extends through all three portions of said piston, said distal portion having a diameter substantially equal to said annular lip, said outer surface of said distal portion having a pair of spaced depressions therein extending around said piston, each of a pair of seals being positioned in one of said depressions, said middle portion having a diameter smaller than said diameter of said distal portion and greater than a diameter of said opening in said cap such that a shoulder is defined between said distal and middle portions;

a biasing member for biasing said piston toward said aperture in said first covering, said biasing member extending between and abutting against said shoulder and said cap, said biasing member comprising a compression spring wound about said piston;

a second covering for positioning over said second end of said tubular body, said second covering having a first side, a second side and a peripheral edge extending between said first and second sides, said peripheral edge of said second covering being adapted for threadably engaging said peripheral wall such that said second covering covers said opening in said second end, said second covering having an aperture extending therethrough being positioned generally co-axial with said aperture in said first covering, an annular flange being attached to an edge of said aperture in said second covering and extending away from said tubular body, said annular flange on said second covering being threaded for releasably engaging said water supply pipe such that water may flow outwardly of said tubular body through said second covering, said aperture in said second covering having a first portion abutting said first side, a second portion abutting said second side and a middle portion located between said first and second portions, said second portion having a funnel shape and narrowing toward said middle portion, said middle portion and said first portions having a cylindrical shape, said middle portion having a greater diameter than said first portion such that a ledge is defined between said first and third portions;

a one-way valve being removably coupled to said proximal portion of said piston, said one-way valve being adapted for letting water move outwardly through proximal portion of said piston, said one-way valve having a size adapted for extending into said second and middle portions of said aperture in said second covering, said one-way valve being extendable between an open position retracted inward of said piston and a closed position extending outward of said piston, said valve being abuttable against said ledge such that the one-way valve is biased into said open position such that water may flow through said piston and outward through said second covering, said one-way valve having an outer surface having a groove therein, a seal being positioned in said groove for generally forming a seal between said one-way valve and said middle portion of said aperture when said valve is located in said aperture, a pin-hole extending through said one-way valve for releasing water pressure;

a first filter being attached to said first covering and being located in said aperture in said first covering;

a second filter being attached to said one-way valve, said second filter being located within said piston and covering said pin hole;

an alarm system for signaling a malfunction of said piston, said alarm system including;

a coupler for positioning between and fluidly coupling said water supply pipe and said flange on said first covering;

a diaphragm being attached to an inner wall of said coupler, said diaphragm being resiliently elastic;

a pin extending through an outer wall of said coupler and having a first end abutting said diaphragm, wherein said diaphragm forms a seal around said pin;

an urging member urges said pin against said diaphragm such that said diaphragm is urged toward a central area of said coupler;

a switch being attached to said coupler, a second end of said pin extending through said coupler and engaging said switch, said switch including a first contact being attached to said coupler and a second contact being attached to said second end of said pin, wherein said first and second contacts abut each other when said pin is urged inward of said coupler;

a power supply being operationally coupled to said second contact;

a first interior contact being positioned in said aperture in said second covering and extending inward of said tubular body, said first contact on said coupler being operationally coupled to said first interior contact;

a second interior contact being positioned in said aperture in said second covering and extending inward of said tubular body, said second interior contact being positioned generally opposite of said first interior contact, said second interior contact being operationally coupled to said power supply;

a third interior contact being attached to and extending around said piston, said third interior contact being located on said proximal portion of said piston, wherein said third interior contact comes in contact with said first and second interior contacts when said piston extends toward said second end of said tubular member to close a circuit between said first contact of said switch and said power supply;

a speaker for emitting a sound being electrically coupled to said switch;

a light being electrically coupled to said switch;

a test button being operationally coupled to said power supply, said light and said speaker, wherein depressing said test button illuminates said light and sounds said speaker to test the power supply; and wherein the speaker will emit a sound and the light will be illuminated if water pressure in said coupler is sufficiently low such that said first contact abuts said second contact and said piston does not retract away from said second covering such that the circuit is closed.

* * * * *